US005197392A

United States Patent [19]

Jeunehomme

[11] Patent Number: 5,197,392

[45] Date of Patent: Mar. 30, 1993

[54] LINKAGE FOR ARTICULATED VEHICLES, IN PARTICULAR RAIL VEHICLES

[75] Inventor: Sylvie Jeunehomme, La Jarne, France

[73] Assignee: GEC Alsthom SA, Paris, France

[21] Appl. No.: 901,019

[22] Filed: Jun. 19, 1992

[30] Foreign Application Priority Data

Jun. 20, 1991 [FR] France ..... 91 07603

[51] Int. Cl.[5] ..... B60D 7/00

[52] U.S. Cl. ..... 105/3; 213/75 R

[58] Field of Search ..... 105/1.4, 3, 4.3, 8.1; 213/1 R, 75 R; 280/403, 400, 408

[56] References Cited

U.S. PATENT DOCUMENTS 4,455,033 6/1984 Becker et al. ..... 105/3
5,052,707 10/1991 Timan ..... 105/3

FOREIGN PATENT DOCUMENTS 0291681 11/1988 European Pat. Off. .
1227049 10/1966 Fed. Rep. of Germany ..... 105/3
0370159 4/1939 Italy ..... 280/403
0254316 3/1964 Netherlands ..... 105/3
359733 1/1962 Switzerland .
2139582 11/1984 United Kingdom .

*Primary Examiner*—Mark T. Le
*Attorney, Agent, or Firm*—Sughrue, Mion, Zinn, Macpeak & Seas

[57] ABSTRACT

A linkage for articulated vehicles, in particular rail vehicles, the linkage serving to provide connection between an intercommunication tunnel supported by a bogie and the ends of adjacent cars supported by the intercommunication tunnel, the cars and the intercommunication tunnel being coupled together near the bottoms thereof, the linkage being characterized in that the end of each car (2, 3) is connected to the tunnel (1) near the top thereof by means of a connection rod (10, 11), with the connection rods being interconnected by link elements, the assembly constituted by the connection rods and the link elements constituting a deformable parallelogram.

5 Claims, 5 Drawing Sheets

LINKAGE FOR ARTICULATED VEHICLES, IN PARTICULAR RAIL VEHICLES

The invention relates to a linkage for articulated vehicles, in particular rail vehicles suitable for use as trams (i.e. streetcars).

In tram type rail vehicles, intercommunication can be provided between cars by intercommunication tunnels supported on bogies. Under such circumstances, the cars are carried, at least in part, by the intercommunication tunnel. Thus, a nonmotorized car is carried by two intercommunication tunnels, while a motorized car has its own bogie at one end while its other end rests on an intercommunication tunnel.

With such a disposition, undesirable phenomena may occur such as galloping and difficulty in securing the top portions of the cars transversely relative to the intercommunication tunnels. For example, if one of the cars supported by an intercommunication tunnel is more heavily loaded than the other, there is a risk of sustained galloping motion for the intercommunication tunnel while the cars are running.

One solution for solving the problem of transverse support consists in using coupling plates of the type used for trailers of lorries (i.e. trucks) for providing sufficient support low down. Nevertheless, that system generates large stresses and does not solve the problem posed in satisfactory manner.

In order to mitigate these drawbacks, the linkage of the present invention serves to link the top of an intercommunication tunnel with the ends of the adjacent cars by means of a deformable system. The system provides transverse support while nevertheless allowing movement across dips or humps, i.e. allowing the distance between the top portions of the vehicles to vary. It enables the vertical opening or closing angles on either side of the intercommunication tunnel to be kept identical regardless of the topography of the track (flat, dipped, humped, curved, etc.), and to eliminate roll between vehicles.

The invention thus provides a linkage for articulated vehicles, in particular rail vehicles, the linkage serving to provide connection between an intercommunication tunnel supported by a bogie and the ends of adjacent cars supported by the intercommunication tunnel, the cars and the intercommunication tunnel being coupled together near the bottoms thereof, the linkage being characterized in that the end of each car is connected to the tunnel near the top thereof by means of a connection rod, with the connection rods being interconnected by link elements, the assembly constituted by the connection rods and the link elements constituting a deformable parallelogram.

Each link rod may be connected to the intercommunication tunnel and to one of the cars by means of ball joints.

Advantageously, the said link elements have a ball joint at one end and a bearing at the other. The link elements may be constituted by rods or by cables.

The invention will be better understood and other characteristics and features will appear on reading the following description given by way of non-limiting example and referring to the accompanying drawings, in which.

Figure 1:
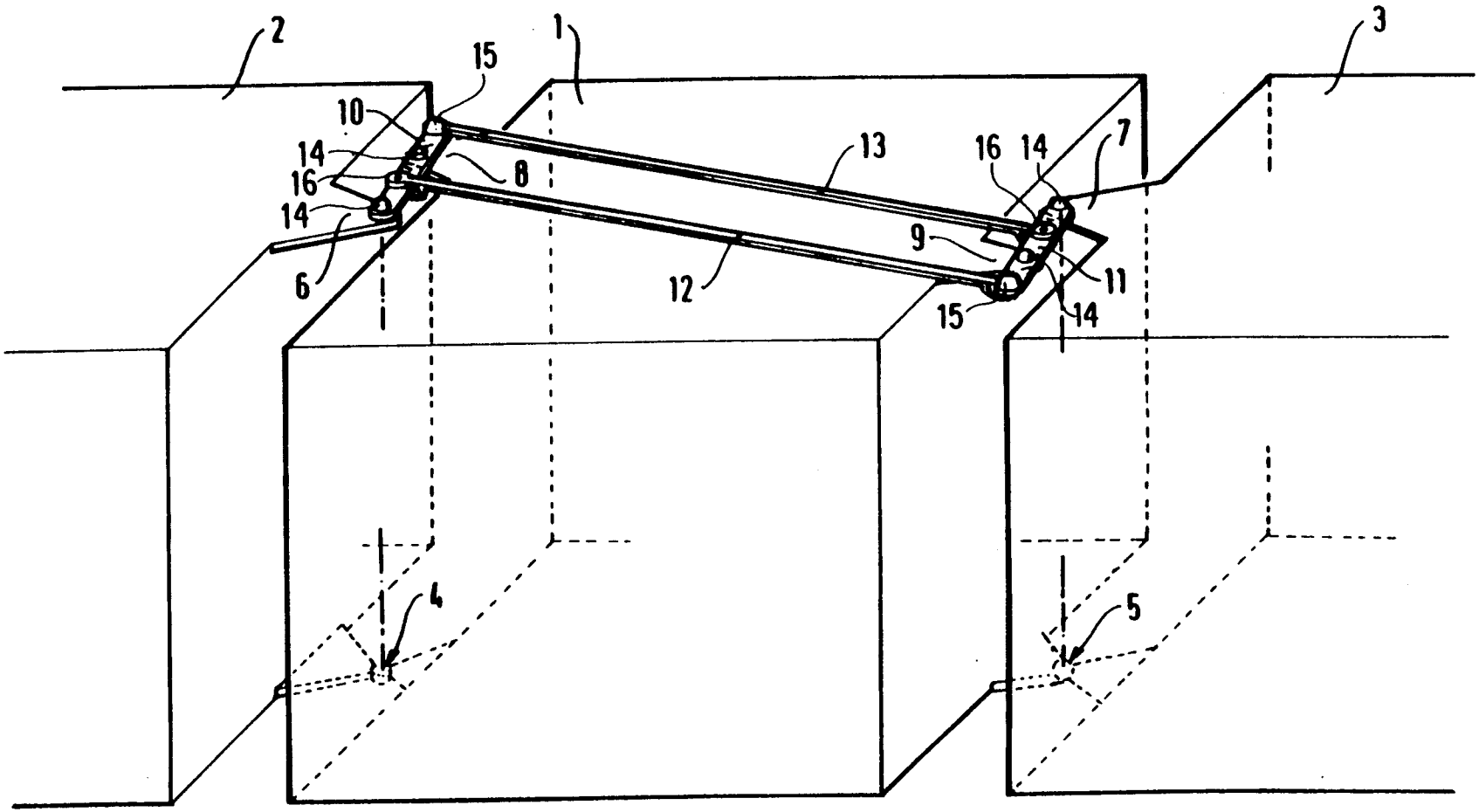
FIG. 1 is a diagrammatic perspective view of the linkage of the invention for rail vehicles.

FIG. 1 shows an intercommunication tunnel 1 extending between two cars 2 and 3. The intercommunication tunnel supports the bottoms of the cars, e.g. via ball type coupling devices 4 and 5. The tops of the cars 2 and 3 include respective articulation supports 6 and 7 situated on the longitudinal axis of symmetry of the vehicles and projecting towards the intercommunication tunnel 1. The top of the intercommunication tunnel likewise includes articulation supports of the same type, referenced 8 and 9 and projecting towards the cars. The articulation supports 8 and 9 are not situated on the longitudinal axis of the vehicles, but they are offset relative to said axis, one being on one side of the axis and the other being on the other side.

Each of the top articulation supports of an intercommunication tunnel is connected to the top articulation support of the adjacent car by means of a connection rod. Thus, rod 10 interconnects supports 6 and 8 while rod 11 interconnects supports 7 and 9. The connections between the rods and the supports are ball joints 14.

The rod 10 extends beyond articulation support 8 to be connected at a first end to a rod 13 that extends longitudinally over the intercommunication tunnel. The second end of the rod 13 is connected to the connection rod 11 at a point situated between the supports 7 and 9.

The rod 11 extends beyond the articulation support 9 to be connected at a first end to a rod 12 extending longitudinally over the intercommunication tunnel. The second end of the rod 12 is connected to the connection rod 10 at a point situated between the supports 6 and 8.

The rods 12 and 13 may be called intercar rods. The intercar rods 12 and 13 and the connection rods 10 and 11 form a parallelogram lying in a plane parallel to the track.

The connections between the rods 10 and 13 and the rods 11 and 12 are ball joints 15. The connections between the rods 10 and 12 and between the rods 11 and 13 are bearings 16.

It is particularly advantageous for the ends of the intercar rods 12 and 13 to be mounted halfway between the corresponding tunnel and car articulation supports.

Figure 2:
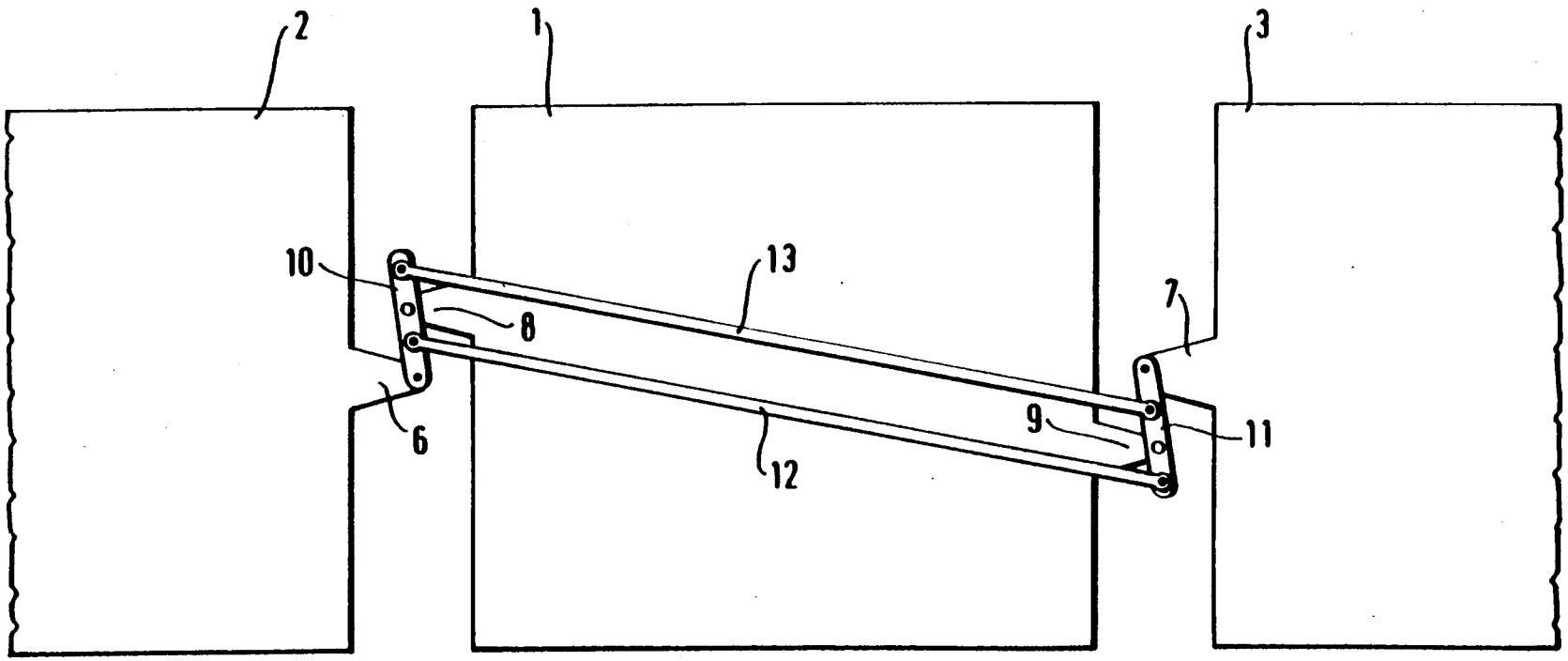
FIG. 2 is a plan view of rail vehicles using the linkage of the invention and running on flat ground.

FIG. 2 is a plan view of the linkage of the invention for vehicles running on flat ground. In this case, the connection rods 10 and 11 are practically parallel to a direction extending transversely to the vehicles. On flat ground (i.e. when the set of vehicles lies in the same plane) or on a track that is merely curved, the linkage of the invention may be subjected to mechanical forces on the rods 10 and 11 without the assembly constituted by the rods 10, 11, 12, and 13 moving.

When the leading car 2 engages a bump or a hump, the top of the rear end of said car tips towards the intercommunication tunnel 1, thrusting against the connection rod 10. The resulting rotation of the connection rod 10 moves both intercar rods 12 and 13 proportionally, thereby causing the connection rod 11 to move by the same amount. It pivots and the top of the intercommunication tunnel moves towards the top of the car 3. The two cars 2 and 3 are therefore both at the same distance from the intercommunication tunnel 1.

Figure 3:
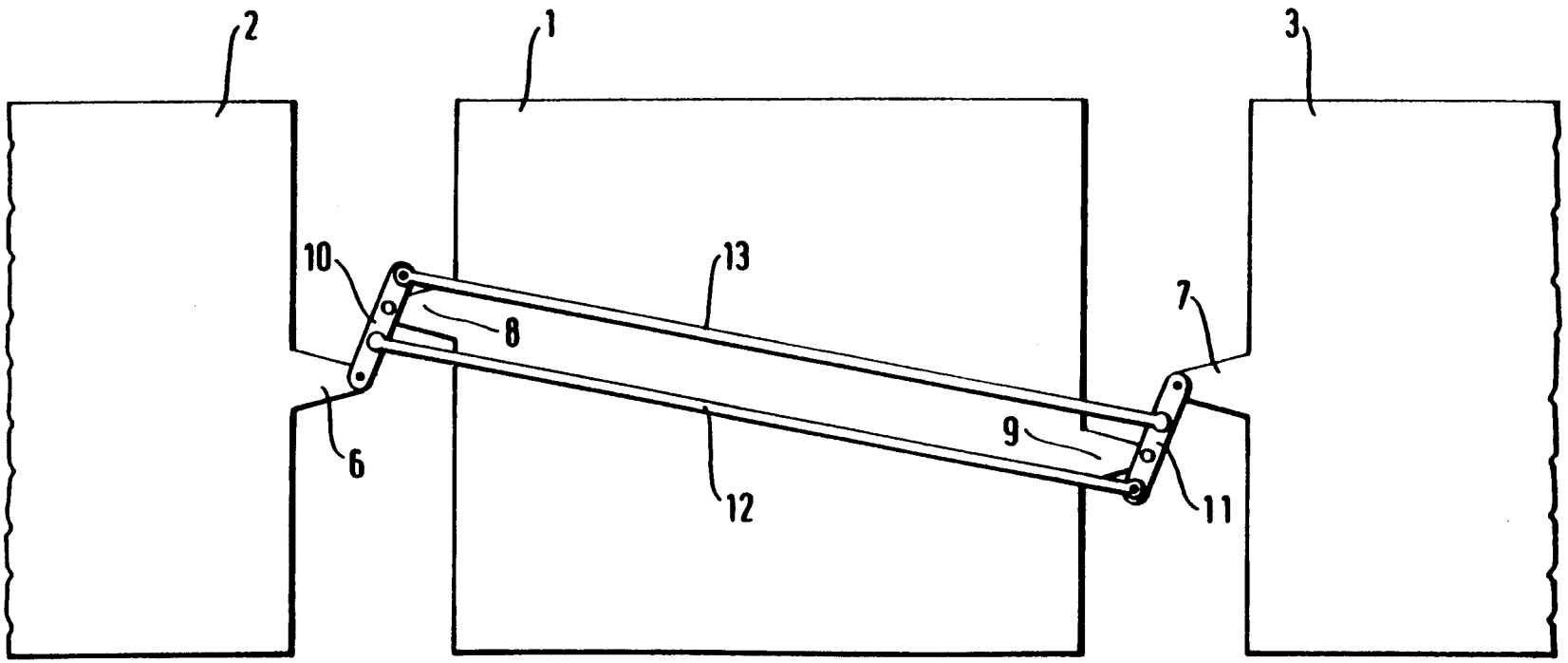
FIG. 3 is a plan view of rail vehicles using the linkage of the invention and running over a hump.

FIG. 3 shows the case where the intercommunication tunnel 1 is at the top of a hump, with the front car 2 beginning to move down the hump while the rear car 3 continues to move up. The distance between the top of the tunnel 1 and each of the cars is thus greater than the corresponding distance for vehicles running on flat ground (as shown in FIG. 2).

When the track has a dip, the opposite phenomenon occurs.

Figure 4:
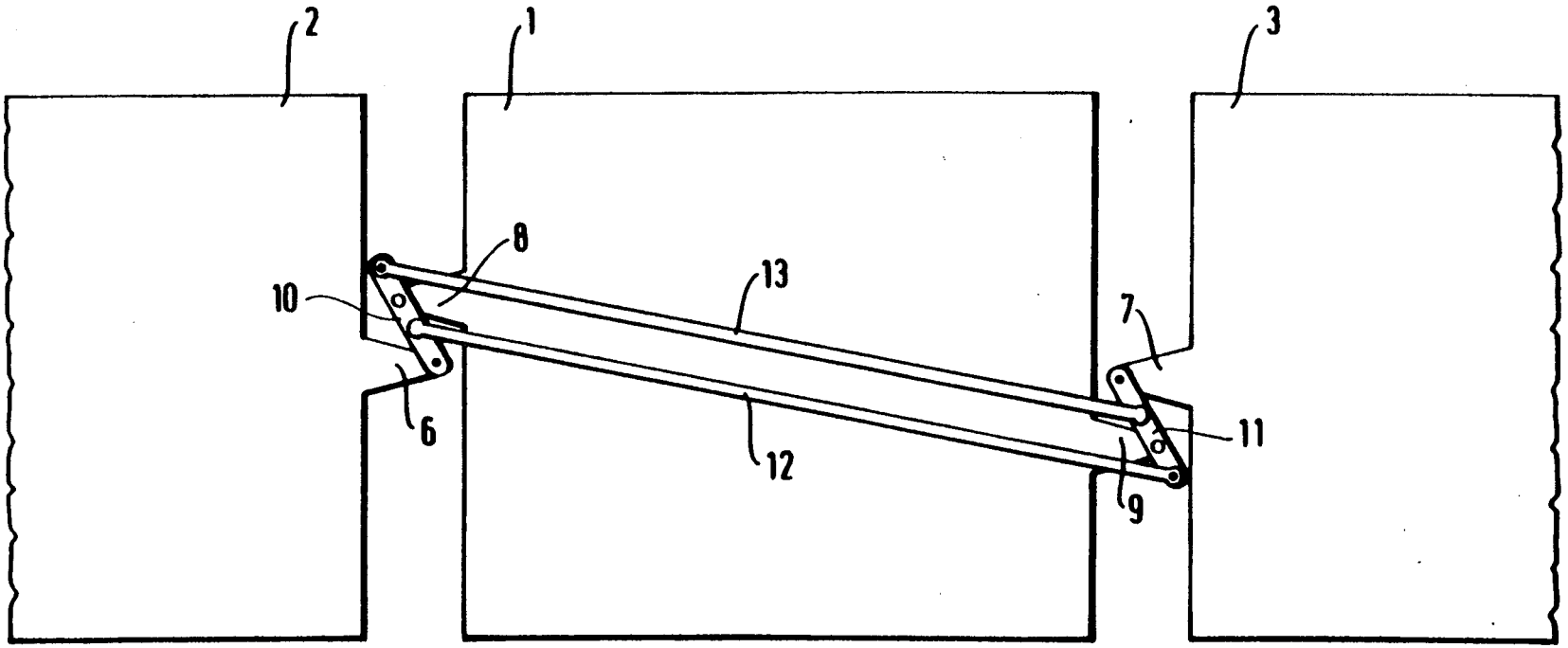
FIG. 4 is a plan view of rail vehicles using the linkage of the invention and running over a dip.

FIG. 4 shows the case where the intercommunication tunnel 1 is at the bottom of a dip, with the front car 2 beginning to move up from the dip while the rear car 3 is continuing to move down into the dip. The distance between the tunnel 1 and each of the cars is then less than the corresponding distance for vehicles running on flat ground.

Figure 5:
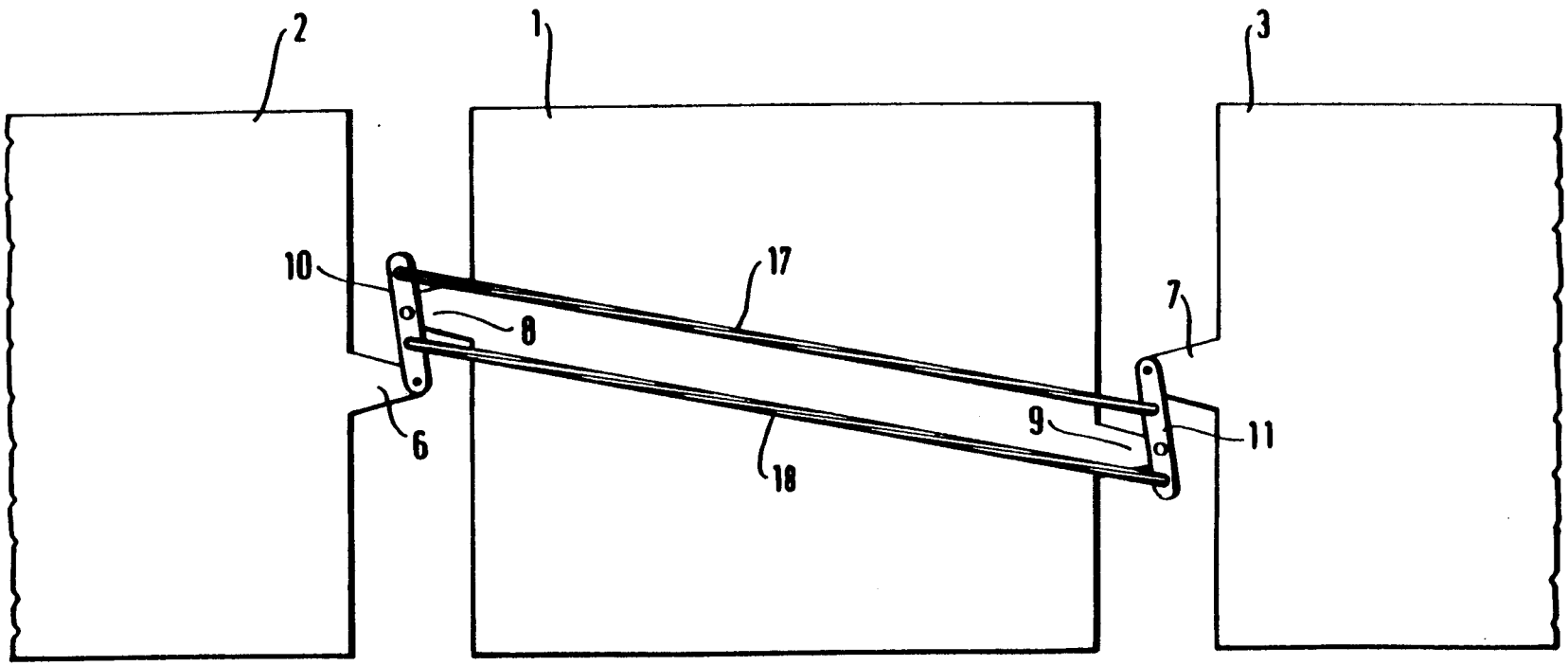
FIG. 5 is a plan view of rail vehicles using the linkage different from the linkage shown in FIG. 2.

FIG. 5 shows another embodiment of the linkage which is generally similar to that shown in FIG. 2, except that the link elements are constituted by cables 17, 18 instead of rods 13, 12.

In conclusion, for given topography, there exists one position and only one position for the linkage of the invention, thereby excluding any phenomenon of the intercommunication tunnel galloping.

I claim:

1. A linkage for articulated rail vehicles, the linkage serving to provide connection between an intercommunication tunnel and the ends of adjacent cars supported by the intercommunication tunnel, the cars and the intercommunication tunnel being coupled together near the bottoms of the cars and the tunnel, the linkage being characterized in that the end of each car (2, 3) is connected to the tunnel (1) near the tops of the car and the tunnel by means of a connection rod (10, 11), with the connection rods being interconnected by link elements, and the connection rods and the link elements form a deformable parallelogram.

2. A linkage according to claim 1, characterized in that each connection rod is connected to the intercommunication tunnel and to one of the cars by means of ball joints.

3. A linkage according to claim 1, characterized in that each of said link elements has a ball joint at one end and a bearing at the other.

4. A linkage according to claim 1, characterized in that the link elements are also rods (12, 13).

5. A linkage according to claim 1, characterized in that the link elements are cables.

* * * * *